United States Patent [19]

Helm et al.

[11] Patent Number: 4,601,402

[45] Date of Patent: Jul. 22, 1986

[54] STEERABLE CONCENTRIC RING SEGMENT SUPPORTED LIFT CRANE

[75] Inventors: Percy R. Helm; James G. Morrow, Sr., both of Manitowoc, Wis.

[73] Assignee: The Manitowoc Company, Inc., Manitowoc, Wis.

[21] Appl. No.: 259,932

[22] Filed: May 4, 1981

Related U.S. Application Data

[63] Continuation-in-part of Ser. No. 128,248, Mar. 7, 1980, Pat. No. 4,316,548.

[51] Int. Cl.[4] ..... B66C 23/78

[52] U.S. Cl. ..... 212/189; 212/178; 212/227; 212/248

[58] Field of Search ..... 212/178, 189, 191, 195–198, 212/223, 227, 231–233, 244, 245, 255, 265, 247, 248

[56] References Cited

U.S. PATENT DOCUMENTS

| | | | |
|---|---|---|---|
| 1,610,502 | 12/1926 | Fairbanks et al. | 212/248 |
| 2,068,397 | 1/1937 | Chapman | 212/233 |
| 2,139,960 | 12/1938 | Kauffman | 212/195 |
| 2,949,162 | 8/1966 | Davis | 212/247 |
| 3,836,010 | 9/1974 | Lampson | 212/196 |
| 3,868,022 | 2/1975 | Greenlay et al. . | |
| 3,900,077 | 8/1975 | Gee et al. | 180/9.46 |
| 4,020,952 | 5/1977 | Scodino | 212/189 |
| 4,042,115 | 8/1977 | Beduhn et al. | 212/178 |
| 4,076,128 | 2/1978 | Tax | 212/195 |
| 4,196,816 | 4/1980 | Dvorsky et al. | 212/195 |
| 4,243,148 | 6/1981 | Lampson | 212/196 |

FOREIGN PATENT DOCUMENTS

| | | | |
|---|---|---|---|
| 201812 | 1/1959 | Austria | 212/195 |
| 834148 | 8/1938 | France | 212/247 |

*Primary Examiner*—Trygve M. Blix
*Assistant Examiner*—R. Johnson
*Attorney, Agent, or Firm*—Leydig, Voit & Mayer, Ltd.

[57] ABSTRACT

Front and rear pairs of crawler assemblies are provided for supporting concentric ring segments disposed forwardly under the boom and rearwardly under the counterweight so the crane can travel under load and swing through at least a partial horizontal arc. One and preferably both crawler assemblies are selectively and reversely powered to facilitate forward and reverse as well as turning movement during travel under loaded and unloaded conditions. The inner ring segment is at least partially surrounded by a rotatable cage structure which provides a connection point for a frame element extending to the forwardly disposed crawler assembly to permit independent steering of the rear crawler assembly.

5 Claims, 4 Drawing Figures

Fig. 2.
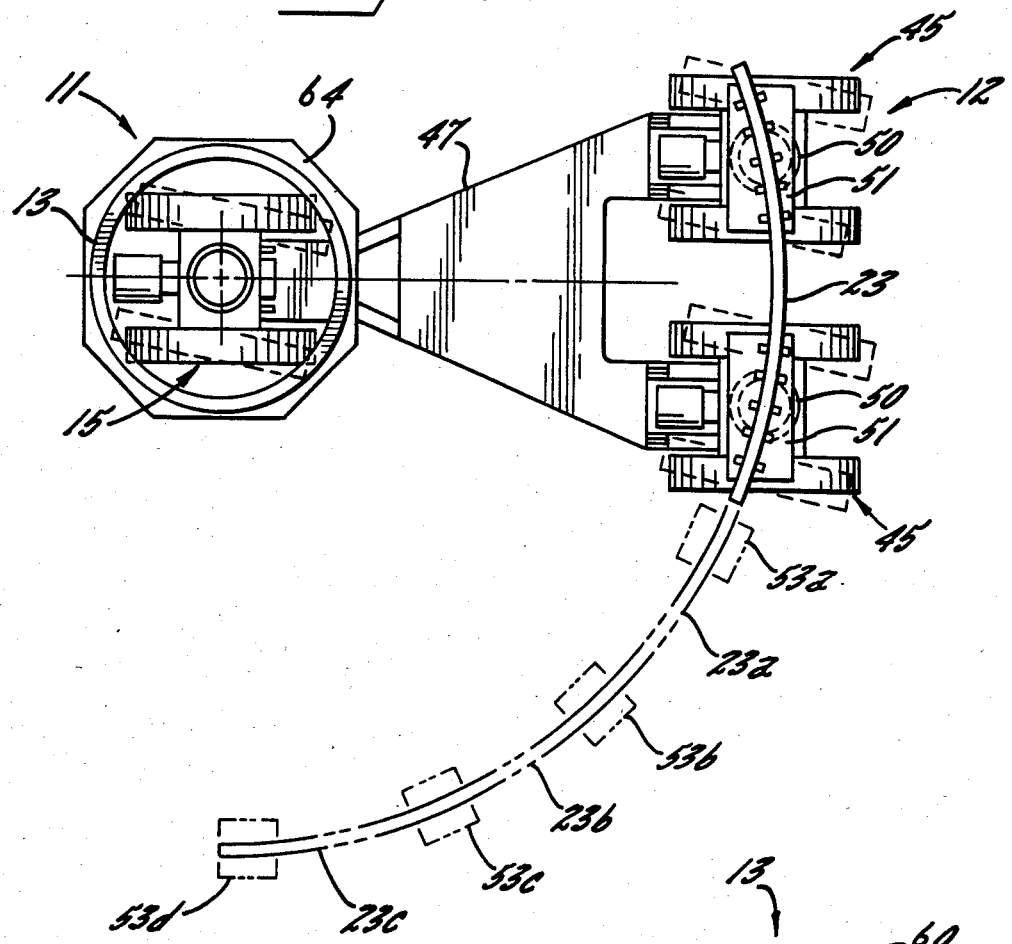
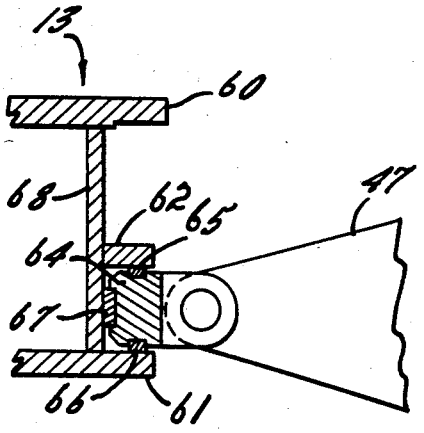
Fig. 4.
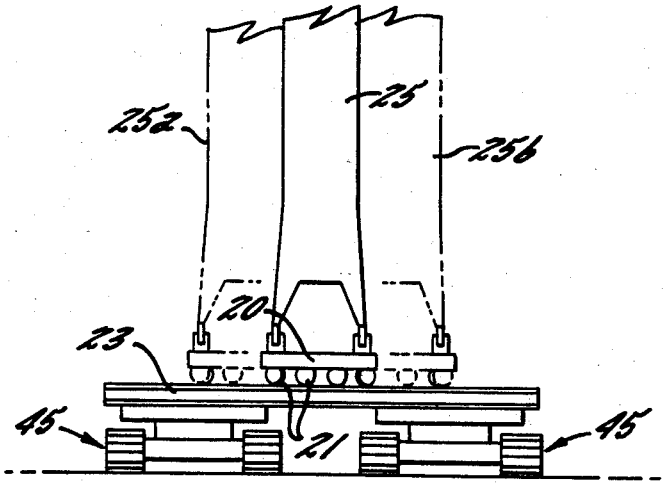
Fig. 3.

STEERABLE CONCENTRIC RING SEGMENT SUPPORTED LIFT CRANE

RELATED APPLICATIONS

The present application is a continuation-in-part of our copending application Ser. No. 128,248, filed Mar. 7, 1980, now U.S. Pat. No. 4,316,548, issued Feb. 23, 1982.

FIELD OF THE INVENTION

This invention relates generally to heavy lift cranes and more particularly concerns a steerable mobile concentric ring supported crane.

In response to ever-increasing user needs, self-propelled cranes have been made capable of lifting ever greater loads. While a number of factors enter into determining crane capacity, a basic limitation arises from the fact that, inevitably, the weight of the crane and its load must be transferred to the earth in some stable fashion and, if rotation of the load is desired, the crane-earth connection must be made stable through the arc of crane rotation.

A significant increase in crane capacity was achieved by providing a self-propelled crane with the support ring and extended boom carrier disclosed and claimed in U.S. Pat. Nos. 3,485,383; 3,878,944; and 4,196,816. In these designs, the weight of the crane and its load is transferred to the ground through a large diameter, track-like ring. As shown in these patents, and as practiced commercially for some years, the support ring is either blocked into place by timbers fitted and wedged beneath and completely around the ring or is supported by a plurality of jacks spaced around the periphery of the ring.

Further refinements in ring supported cranes are disclosed in U.S. Pat. Nos. 4,042,115 and 4,103,783 and copending U.S. application Ser. Nos. 058,284, and 058,285, both filed July 17, 1979. These patents and applications disclose inter alia that a separate transporter mechanism may be run in and out of an otherwise stationary ring supported crane in order to move that crane between different locations or transporter mechanisms and/or idle crawlers or dollies may be installed beneath the ring under the boom foot and counterweight.

SUMMARY OF THE INVENTION

The primary aim of the present invention is to provide a heavy lift crane assembly having an upper structure including machine works and a counterweight pivotally mounted for horizontal movement on a ring structure with a boom and mast mounted on a boom carrier for horizontal rotation on a concentric ring segment spaced outwardly from the main ring. Also provided are means interconnecting the counterweight carrier and the boom top and traveling supports for the main ring and auxiliary ring segments, including front and rear pairs of laterally spaced crawler assemblies respectively located under the main ring under the counterweight and under the auxiliary ring segment beneath the boom carrier with means for selectively and reversibly driving the tracks to permit movement of the crane and ring segments over the ground while the boom is lifting a load. A rotatable cage-like structure at least partially surrounds the inner ring segment and is connected to the front crawler assemblies to permit independent turning of the rear crawler assemblies.

Other objects and advantages of the invention will become apparent upon reading the following detailed description and upon reference to the drawings, in which:

BRIEF DESCRIPTION OF THE DRAWINGS

FIG. 2 is a section taken substantially along line 2—2 in FIG. 1;

FIG. 3 is a fragmentary front elevation of the crane shown in FIG. 1 with a single boom illustrated in solid lines and dual booms illustrated in broken lines; and, FIG. 4 is an enlarged fragmentary side elevation of a portion of the cage-like structure at least partially surrounding the inner ring.

DETAILED DESCRIPTION OF THE INVENTION

Figure 1:
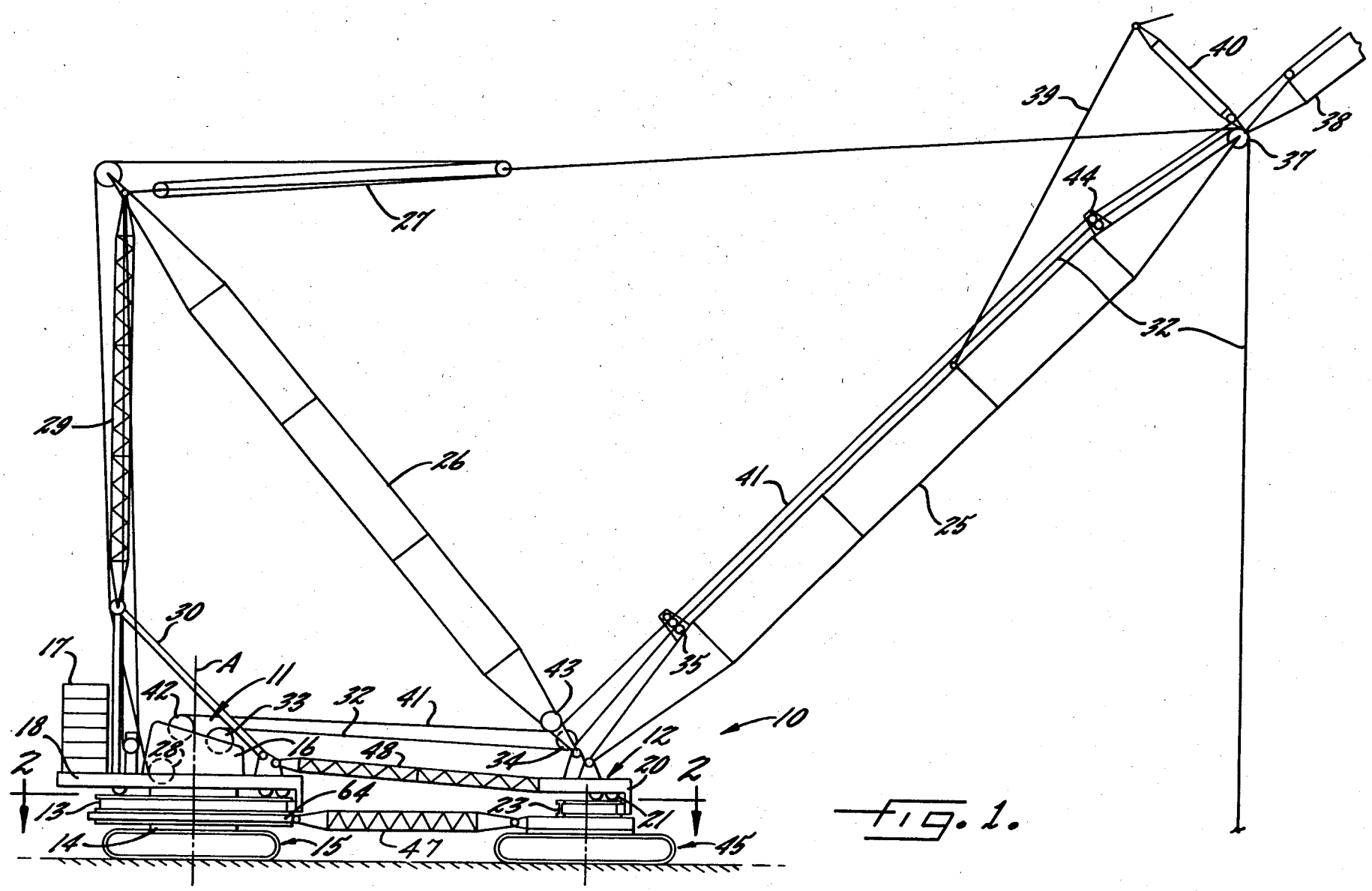
FIG. 1 is a side elevation of the steerable concentric ring segment supported lift crane of the present invention.

Turning now to the drawings, there is shown in FIG. 1 the concentric ring segment supported lift crane 10 of the present invention. The crane 10 includes a rear machinery and counterweight support mechanism 11 and a front boom and mast support mechanism 12. In the illustration of FIG. 1 the machinery and counterweight support mechanism 11 includes a large diameter ring 13 supported by a substantially rectangular frame 14 on a self propelled transporter mechanism 15 substantially as disclosed in U.S. Pat. No. 4,195,740, which is hereby incorporated by reference. Suffice it to say that the ring-like track 13 is on the order of 36 feet in diameter and the lift machinery 16 and counterweight 17 are supported on a rotatable deck 18 for movement about the ring center line designated A.

The front boom and mast carrier mechanism 12 includes a carrier 20 supported by rollers 21 on a front ring segment 23 which is concentric with the axis A of the rear ring 13 and has a different radius of curvature. The carrier 20 pivotally mounts a forwardly inclined boom 25 and a rearwardly inclined mast 26. The tip of the mast 26 is connected to the tip of the boom 25 by variable length rigging 27 which includes a multiple part line wound on a boom hoist drum 28 located on the machinery deck 18. The upper end of the mast 26 is also connected by means of a fixed length pendant or strut 29 to a gantry 30 carried on the machinery deck 18. In this way the counterweight 17 is connected to the mast top and through the rigging 27 is applied to the boom tip to counteract the moment of a heavy load.

In the configuration shown in FIG. 1 the crane 10 includes a primary lift line 32 wound on a winch drum 33 and reeved around guide sheaves 34 and 35 and a boom tip sheave 37. The boom 25 is also provided with a jib section 38 supported by guy pendants 39 and a strut 40. An auxiliary lift line 41 is wound on another drum 42 and is guided by sheaves 43 and 44 to the tip (not shown) of the jib 38.

Pursuant to the present invention the front boom support mechanism 12 is carried on one or more transporter assemblies 45 interconnected by a frame elements 47 to the rear machinery transporter 15. The front transporters 45 are preferably demountable self-propelled assemblies such as shown in U.S. Pat. Nos. 4,000,784 and 4,069,884 which are incorporated herein by reference. It will be appreciated that by suitably controlling the front transporter assemblies 45 and the rear machinery transporter 15 the crane 10 may be moved over the terrain in either a loaded or an unloaded condition.

In keeping with another aspect of the invention, the boom carrier 20 is rotatable on the front ring segment 23 in order to swing a load through at least a partial horizontal arc. Swinging movement may be provided through a web-like strut 48 connected to the rear machinery deck 18, and the front carrier 20 or, alternatively, the carrier 20 may be rotated on its ring segment 23 by one or more independent swing drive mechanisms such as shown in U.S. Pat. Nos. 3,949,881 and 4,013,174 which are also incorporated herein by reference.

As shown in FIG. 2, a pair of front transporter assemblies 45 are provided to support the ring segment 23. Each transporter 45 carries a pivot ring 50 on which a base plate 51 is mounted. This permits the transporter mechanisms 45 to be propelled, as disclosed in U.S. Pat. No. 4,069,884 to move in forward, reverse or turning directions (the latter being shown in broken lines). Since the transporters 45 support the ring segment 23 on which the boom carrier 20 rides, the crane 10 may move under either loaded or unloaded conditions.

According to the present invention, heavy lifts and placement of loads can also be made which require swinging the load through a substantial arcuate segment, for example 90° or more. This is particularly useful in making multiple lifts of loads from a carrier, such as a ship or barge and placement of the loads on a dock or pier. Accordingly, as shown in dash lines in FIG. 2, additional concentric ring segments 23*a, b* and *c* may be attached to the primary ring segment 23, and these additional ring segments 23*a, b, c,* etcetera, may be blocked or jacked into level position such as by the bolsters shown at 53*a, b, c* and *d.*

It will be appreciated, of course, that a single boom 25 may be supported by the front carrier 20 (as shown in solid lines in FIG. 3) or spaced-apart dual booms may be provided. In the latter instance it is desirable to provide dual transporter mechanisms 45, while a single front transporter may be sufficient if a single boom 25 and only limited swinging of the load is contemplated for a particular lift.

It is another feature of the invention that the rear transporter 15 may be steered independently of the forward transporter assemblies 45. To facilitate turning the rear transporter 15, the rear ring 13 is provided with upper, lower and intermediate flanges 60, 61 and 62 and a rotatable cage-like structure 64 at least partially surrounds the lower portion of the ring 13. Preferably, the cage 64 completely encircles the ring 13 as shown in FIGS. 1 and 2 and, as shown in FIG. 4, the cage 64 is provided with upper, lower and inner bearing elements 65, 66 and 67 respectively, which ride against the lower flange 61, the intermediate flange 62 and the vertical web 68 of the ring 13. It will be appreciated that the cage 64 acts like a large slip ring and permits steering of the rear transporter 15 without altering the fore and aft alignment of the boom carrier mechanism 20, the counterweight support means 18 and the intermediate support linkages 47 and 48.

It should also be appreciated that the embodiments shown in FIGS. 4 and 5 of copending application Serial No. 128,248 may also employ a similar cage-like slip ring (as shown here in FIG. 4) and either single or dual front transporter assemblies 45 (as shown here in FIGS. 2 and 3) and either single or dual booms 25 (as shown here in FIG. 3). Likewise additional concentric ring segments 23*a–c* (as shown in FIG. 2) may be attached and supported by blocks, bolsters, jacks or the like.

From the foregoing, it will be seen that a heavy lift crane 10 is provided utilizing a standard "Ringer" crane as the rear lift machinery and counterweight support and a front concentric ring segment for supporting the boom and mast and transmitting the load down through a self-propelled transporter assembly into the ground. The crane is self-propelled and may move under loaded or unloaded conditions and may also be steered by turning the rear transporter 15, the front transporters 45 either together or independently.

We claim as our invention:

1. A lift crane having a forwardly inclined boom and a rearwardly inclined mast, said boom and mast being pivotally mounted on a boom carrier mechanism, rigging means interconnecting the tip of the mast and the tip of the boom, counterweight means supported by rollers on a rear ring segment for rotation about a vertical axis, means interconnecting said counterweight and the top of said mast, said boom carrier supported by rollers on a front ring segment for at least partial circumferential rotation about said vertical axis, said front and rear ring segments being concentric and having different radii of curvature, said front and rear ring segments each mounted on front and rear mobile support mechanisms respectively, means interconnecting said front and rear support mechanisms to permit movement of said crane as a unit, and said interconnecting means including a rotatable cage-like structure at least partially surrounding said rear ring segment to permit steering of said rear mobile support mechanism without altering the fore and aft alignment of said boom carrier mechanism and said counterweight support means.

2. The combination defined in claim 1 wherein said rear ring segment defines a complete circle and is provided with upper, lower and intermediate horizontal flanges and said cage-like structure completely surrounds said rear ring and is disposed in the channel defined between said lower and intermediate flanges thereof.

3. The combination defined in claim 1 wherein said front and rear mobile support mechanisms are selectively reversible and steerable.

4. The combination defined in claim 1 including additional ring segments connected to said front ring segment and means for supporting said additional ring segments on the ground.

5. A lift crane having a forwardly inclined boom and a rearwardly inclined mast, a boom carrier mechanism with said boom and mast being pivotally mounted thereon, rigging means interconnecting the tip of the mast and the top of the boom, front and rear ring segments cooperating to simultaneously support the lift crane, counterweight means supported by rollers on said rear ring segment for rotation about a vertical axis, means interconnecting said counterweight and the top of said mast, said boom carrier mechanism supported by rollers on said front ring segment for at least partial circumferential rotation about said vertical axis, said front and rear ring segments being concentric and having different radii of curvature, front and rear mobile support mechanisms for supporting said front and rear ring segments respectively, first means interconnecting said counterweight support means and said boom carrier mechanisms for joint and at least partial circumferential rotation about said vertical axis, second distinct means interconnecting said front and rear mobile support mechanisms to permit movement of the crane as a unit, and characterized by said second interconnecting means including a rotatable cage-like structure at least partially surrounding said rear ring segment to permit steering of said rear mobile support mechanism without altering the fore and aft alignment of said boom carrier mechanism and said counterweight support means, which are otherwise interconnected by said first means.

* * * * *